US005180485A

United States Patent [19]

Pennella et al.

[11] Patent Number: 5,180,485

[45] Date of Patent: Jan. 19, 1993

[54] SEPARATION OF INDOLE FROM HYDROCARBONS

[75] Inventors: Filippo Pennella; Fan-Nan Lin; Marvin M. Johnson, all of Bartlesville, Okla.

[73] Assignee: Phillips Petroleum Company, Bartlesville, Okla.

[21] Appl. No.: 757,375

[22] Filed: Sep. 10, 1991

[51] Int. Cl.[5] ..... C10G 25/00; C10G 25/02; C10G 25/12

[52] U.S. Cl. ..... 208/254 R; 208/259

[58] Field of Search ..... 208/254 R, 259

[56] References Cited

U.S. PATENT DOCUMENTS 4,357,276 11/1982 Takasa et al. ..... 260/319.1
4,404,063 9/1983 Honda ..... 203/6

*Primary Examiner*—Theodore Morris
*Assistant Examiner*—Zeinab El-Arini
*Attorney, Agent, or Firm*—K. K. Brandes

[57] ABSTRACT

Indole impurities are removed from hydrocarbon-containing fluids by means of a magnesia-containing sorbent material.

14 Claims, No Drawings

SEPARATION OF INDOLE FROM HYDROCARBONS

BACKGROUND OF THE INVENTION

This invention relates to the removal of indole from hydrocarbon-containing fluids by means of a solid sorbent.

The presence of indole as an impurity in hydrocarbon-containing fluids, in particular light oils, frequently is undesirable because indole can form colored materials and/or gummy deposits. These deposits can cause operational problems during further processing (e.g., of light cycle oil to diesel or jet fuels) or during transport of the hydrocarbon-containing liquids. The present invention provides a simple method of removing indole impurities from hydrocarbon-containing fluids, in particular liquids, by adsorption.

SUMMARY OF THE INVENTION

It is an object of this invention to provide a process for removing indole from hydrocarbon-containing fluids by adsorption. It is a particular object of this invention to provide a process for removing indole impurities from hydrocarbon-containing liquids. Other objects will become apparent from the detailed description of this invention and the appended claims.

In accordance with this invention, a process for at least partially removing indole from a hydrocarbon-containing fluid comprises the step of contacting a fluid which comprises at least one hydrocarbon and indole with a sorbent composition comprising magnesia as the major component (i.e., containing more than about 50 weight-% MgO).

DETAILED DESCRIPTION OF THE INVENTION

Any suitable hydrocarbon-containing fluid which also contains small amounts of indole, generally about 5 ppm (parts by weight of indole per million parts by weight of fluid) to about 0.3 weight-% indole, preferably about 5–1000 ppm indole, more preferably about 10–200 ppm indole, can be used as the feed in the process of this invention. Particularly suited feeds (if they contain indole impurities) are normally liquid (i.e., liquid at about 20° C./1 atm.) hydrocarbon-containing mixtures, preferably those having a boiling range of about 200° F. to about 800° F. (about 93° C. to about 426° C.), more preferably of about 350° F. to about 650° F. (about 177° C. to about 343° C.), at atmospheric pressure. Non-limiting examples of such hydrocarbon-containing liquids are heavy naphtha, kerosine, light gas oils, light cycle oils (produced during catalytic cracking of petroleum or shale oil), and the like. Many of these hydrocarbon-containing feeds are used as feedstocks for making gasoline, diesel fuels, jet engine fuels, heating oils, lubricating oils, and the like.

The hydrocarbon-containing fluid which contains small amounts of indole can be contacted with the sorbent material of this invention in any suitable manner at any suitable adsorption conditions. Generally magnesium oxide containing granules are employed, preferably having a particle size of about 10–50 mesh and a surface area (determined by the BET/$N_2$ method) of about 50–500 $m^2/g$. Preferably, the magnesia-containing sorbent material of this invention contains at least about 90 weight-% MgO. Minor amounts (such as about 0.1–10 weight-%) of other refractory materials (e.g., $SiO_2$, $Al_2O_3$, clays) may be present in the sorbent.

Any suitable, effective contacting means and conditions can be employed. Generally the contacting temperature is in the range of about 10° C. to about 100° C., preferably about 20°–40° C., while the pressure preferably is about 1–2 atm (=about 0–29 psig). The contacting process of this invention can be carried out in a fixed bed or a fluidized bed containing the sorbent material, in an upflow mode or a downflow mode, or the process can be carried out as a slurry process with the sorbent material suspended in a liquid feed. The process can be carried out as a batch process or as a continuous process. Any suitable feed rate can be employed. Preferably, the liquid hourly space velocity (LHSV) of the feed is about 0.1–100 volume (e.g., cc) feed per volume (e.g., cc) sorbent per hour.

Free hydrogen, free oxygen, oxidizing agents, halogenating agents and catalysts which can promote hydrogenation, hydrocracking, oxidation, halogenation and catalytic cracking are substantially absent during the adsorption process of this invention. Thus, the adsorption process of this invention is carried out essentially under non-cracking, non-hydrotreating, non-oxidizing and non-halogenating conditions. It is a particular objective of this invention to take out a substantial portion (preferably over 90%) of the indole contained in the feed, without significantly affecting the chemical makeup or distribution of the hydrocarbons contained in the feed.

Once the sorbent material has substantially been saturated with indole and no longer possesses a desired indole-removal capacity, the adsorption process of this invention is discontinued. The spent sorbent material is either disposed of, generally after adhered hydrocarbons and adsorbed indole have been burnt off, or the spent sorbent material is regenerated by an indole removal step such as by washing it with an effective solvent which will dissolve adsorbed indole and also adhered hydrocarbons. Non-limiting examples of such effective solvents are methanol, acetone, liquid $C_5$–$C_8$ paraffins, liquid $C_5$–$C_8$ cycloalkanes, liquid $C_6$–$C_{10}$ aromatics, and the like. The wash solution can be burned or it can be separated into the various components by distillation. The thus-separated solvent can be reused in the above-described sorbent regeneration process, while indole can be recovered and used as starting material for perfumes, dyes, pharmaceuticals and the like.

The process of this invention will be further illustrated by the following examples, which are not to be construed as unduly limiting the scope of this invention.

EXAMPLE I

This example illustrates the effectiveness of a magnesium oxide sorbent material for removing indole from hydrocarbons containing a small amount of indole.

A 10–40 mesh magnesium oxide material, which contained about 5 weight-% $SiO_2$ as binder and had been calcined at about 500° C., was first substantially dried by heating overnight at 350° C. in a stream of air. Thereafter, the material was heated at about 450° C. for about 3 hours in air and then for about 1 hour at that temperature in a stream of $N_2$ gas. The thus-dried MgO material was allowed to cool in a $N_2$ atmosphere and was stored in a sealed glass container in a moisture-free environment.

In the first test series, 25 cc (15 grams) of the above-described granular MgO material was placed on top of a layer of glass wool in an adsorption tube of about 25 cm length and 1 cm inner diameter. A solution of 0.5 g indole in 200 g n-heptane was passed in a downflow direction under a $N_2$ atmosphere through the MgO-filled adsorption column. The solution which had passed through the adsorption column was analyzed at certain time intervals for its indole content by gas chromatography. Results are summarized below.

TABLE I

| Volume (cc) of Treated Solution | Wt % Indole in Treated Solution |
|---|---|
| 0 (Feed) | 0.25 |
| 10–80 | 0 |
| 110–120 | 0.002 |
| 140–150 | 0.010 |
| 180–190 | 0.033 |
| 200–210 | 0.033 |
| 230–240 | 0.052 |

Test data in Table I clearly show that MgO was effective in removing indole from the indole-heptane solution. It was observed that the top layer of the sorbent material gradually turned blue-green, and that after about 200 cc of the solution had passed through, essentially all of the MgO sorbent material was blue-green.

Washing of the spent MgO sorbent material with pure n-heptane removed some of the adsorbed indole from the MgO sorbent material. The first 50 cc portion of the n-heptane wash liquid which had passed through the spent MgO sorbent contained 0.011 weight-% indole, the second 50 cc portion of n-heptane contained 0.008 weight-% indole, and the third 50 cc portion of n-heptane contained also 0.008 weight-% indole.

In the second test series, a solution of 0.1 g indole in 250 g benzene was passed through 25 cc (15 g) of the dried MgO material described above. Test results, summarized in Table II, essentially confirm the earlier described results.

TABLE II

| Volume (cc) of Treated Solution | Wt % Indole in Treated Solution |
|---|---|
| 0 (Feed) | 0.04 |
| 5–110 | 0 |
| 150–160 | 0.003 |
| 205–215 | 0.020 |

EXAMPLE II

This example illustrates the removal of indole from a light cycle oil (obtained from a refinery of Phillips Petroleum Company) which contained 37 ppm indole as an impurity. 110 cc of the brown light cycle oil was passed through an adsorption column containing 25 cc (15 g) of the dried MgO sorbent material described in Example I. Test conditions were essentially the same as those described in Example I. Test results are summarized in Table III.

TABLE III

| Volume (cc) of Treated Oil | Wt % Indole in Treated Oil |
|---|---|
| 0 Feed | 37 ppm |
| 5–15 | <5 ppm |
| 15–30 | <5 ppm |
| 30–45 | <5 ppm |

TABLE III-continued

| Volume (cc) of Treated Oil | Wt % Indole in Treated Oil |
|---|---|
| 45–60 | <5 ppm |
| 60–75 | <5 ppm |
| 75–90 | <5 ppm |
| 90–98 | <5 ppm |

Note:
5 ppm indole was the detection limit of the indole analysis.

The above test results indicate that essentially all of the indole contained in the light cycle oil was removed by the sorption process of this invention. The thus-treated light cycle oil had a yellow or greenish color (as compared to the brown color of untreated light cycle oil). Washing of the used MgO sorbent material (through which 110 cc of light cycle oil had passed) with pure n-heptane did not indicate a significant removal of adsorbed indole from MgO.

Reasonable variations and modifications which will be apparent to those skilled in the art, can be made within the scope of the disclosure and appended claims without departing from the scope of this invention.

That which is claimed is:

1. A process for at least partially removing indole from a fluid comprising at least one hydrocarbon and indole which comprises the step of contacting said fluid with a sorbent composition comprising more than about 50 weight percent mangesia, at a temperature in the range of about 10° C. to about 100° C.

2. A process in accordance with claim 1, wherein said fluid is liquid at about 20° C. and 1 atm.

3. A process in accordance with claim 2, wherein said fluid has a boiling range of about 200° F. to about 800° F., measured at about 20° C. and 1 atm.

4. A process in accordance with claim 3, wherein said boiling range is about 350° F. to about 650° F.

5. A process in accordance with claim 1, wherein said fluid is liquid at about 20° C. and 1 atm, and the indole content in said fluid is about 5 ppm to about 0.3 weight-%.

6. A process in accordance with claim 5, wherein said indole content is about 5 to about 1,000 ppm.

7. A process in accordance with claim 5, wherein said indole content is about 10 to about 200 ppm.

8. A process in accordance with claim 1, wherein said sorbent composition comprises at least about 90 weight-% MgO.

9. A process in accordance with claim 8, wherein said sorbent composition has a particle size of about 10–50 mesh and a surface area of about 50–500 $m^2/g$, as measured by the BET method employing $N_2$.

10. A process in accordance with claim 1, wherein said contacting is carried out essentially under non-cracking, non-hydrotreating, non-oxidizing and non-halogenating conditions.

11. A process in accordance with claim 1, wherein said temperature is about 20°–40° C.

12. A process in accordance with claim 1, wherein said fluid is liquid at about 20° C. and 1 atm, and said sorbent material is contained in a fixed bed.

13. A process in accordance with claim 1, comprising the additional step of removing adsorbed indole from said sorbent composition after it has been used in said contacting step.

14. A process in accordance with claim 13, wherein said additional step comprises washing said sorbent composition with an effective solvent.

* * * * *